US006088882A

United States Patent [19]

Leifeld

[11] Patent Number: 6,088,882

[45] Date of Patent: Jul. 18, 2000

[54] REGULATED SLIVER DRAWING UNIT HAVING AT LEAST ONE DRAWING FIELD AND METHOD OF REGULATION

[75] Inventor: Ferdinand Leifeld, Kempen, Germany

[73] Assignee: Trützschler GmbH & Co. KG, Mönchengladbach, Germany

[21] Appl. No.: 09/106,453

[22] Filed: Jun. 30, 1998

[30] Foreign Application Priority Data

Jul. 1, 1997 [DE] Germany ..... 197 27 985
May 22, 1998 [DE] Germany ..... 198 22 886

[51] Int. Cl.[7] ..... D01H 5/32

[52] U.S. Cl. ..... 19/239; 19/240; 19/260

[58] Field of Search ..... 19/65 A, 105, 19/150, 152, 157, 159 R, 236, 237, 238, 239, 240, 260, 261, 287, 288, 291, 292, 258

[56] References Cited

U.S. PATENT DOCUMENTS

| | | | |
|---|---|---|---|
| 4,199,844 | 4/1980 | Goetzinger et al. . | |
| 4,791,706 | 12/1988 | Wiening et al. | 19/105 |
| 5,010,494 | 4/1991 | Lord . | |
| 5,134,755 | 8/1992 | Jornot et al. | 19/239 |
| 5,152,033 | 10/1992 | White | 19/240 |
| 5,394,591 | 3/1995 | Jornot et al. . | |
| 5,410,494 | 4/1995 | Hashimoto et al. . | |
| 5,461,757 | 10/1995 | Leifeld | 19/239 |
| 5,544,390 | 8/1996 | Hartung et al. | 19/240 |
| 5,621,948 | 4/1997 | Hartung | 19/150 |
| 5,796,220 | 8/1998 | Clapp et al. | 19/258 |

FOREIGN PATENT DOCUMENTS

| | | |
|---|---|---|
| 0 778 456 | 6/1997 | European Pat. Off. . |
| 26 50 287 | 11/1984 | Germany . |
| 44 04 326 | 10/1994 | Germany . |
| 44 17 433 | 11/1994 | Germany . |
| 195 37 983 | 4/1997 | Germany . |
| 3-104932 | 5/1991 | Japan . |
| 3-113020 | 5/1991 | Japan . |
| 1 413 823 | 11/1975 | United Kingdom . |
| 1 537 531 | 12/1978 | United Kingdom . |

OTHER PUBLICATIONS

Schlichter et al, "Analyse einer Zahnwalzenregulierung an Baumwollstrecken", Melliand Textilberichte Feb. 1986. pp. 79–85.

"Silrotester—ein Prüfgerät für Bänder, Vorgarne und grobe Garne", textil praxisinternational, Jul. 1991, p. 694.

Strecke SB51, SB52, Regulierstrecke RSB51, Schubert & Salzer, Jul. 7, 1988, pp. 2–11.

"Sliver Information System Kit", Trützschler GmbH & Co. KG brochure, pp. 1–15.

*Primary Examiner*—Michael A. Neas
*Assistant Examiner*—Gary L. Welch
*Attorney, Agent, or Firm*—Venable; Gabor J. Kelemen

[57] ABSTRACT

A regulated drawing unit for drawing fiber material includes an inlet through which the fiber material passes before being drafted; an outlet through which the fiber material passes after being drafted; a first arrangement defining a drawing field including drawing roll pairs spaced from one another in a direction of advance of fiber material; a drive system operatively connected to at least one of the drawing roll pairs for setting an extent of draft of the drawing field; a programmable control system having a memory and being connected to the drive system; a sensor for determining the mass of the fiber material running through a location and for applying signals to the memory; and a second arrangement for deriving information from data stored in the memory for adjusting the roll pair. The second arrangement includes a third arrangement for forming, from the information, a spectrogram of the fiber material and for evaluating properties of the spectrogram to use such properties in adjusting the roll pair.

19 Claims, 5 Drawing Sheets

REGULATED SLIVER DRAWING UNIT HAVING AT LEAST ONE DRAWING FIELD AND METHOD OF REGULATION

CROSS REFERENCE TO RELATED APPLICATIONS

This application claims the priority of German Application Nos. 197 27 985.6 filed Jul. 1, 1997 and 198 22 886.4 filed May 22, 1998, which are incorporated herein by reference.

BACKGROUND OF THE INVENTION

This invention relates to a regulated drawing unit for fiber material, such as a plurality of simultaneously advanced slivers (hereafter "sliver bundle") and is of the type which has at least one drawing field, a controllable and/or regulatable driving system for determining the extent of draft in the respective drawing field, a programmable control for the driving system and at least one sensor for determining the running fiber mass per length unit at a measuring location. Further, a draft-determining signal is stored over a predetermined period in a memory, and information is obtained from the stored values for adjusting the drawing unit.

In a known regulated drawing unit information is gathered for adjusting the drawing unit and/or for judging the quality of the master sliver bundles. Such information includes, for example, the CV value, the spectrogram and/or the length variation curve of the inputted sliver material. The draft-determining signal may be an output signal of a sensor or a setting signal for the drive system. It is a disadvantage of such conventional arrangements that the adaptation of the drawing unit to the regulation of the main drawing process, that is, to an rpm-regulation of the drive motors for the rolls of the drawing unit can be effected only in a limited manner. It is a further drawback that the information may be gleaned only from data concerning the inputted sliver material. Further, obtaining information is complex and also, the adaptation may be provided only for a certain processed assortment.

SUMMARY OF THE INVENTION

It is an object of the invention to provide an improved regulated drawing unit as well as a control and regulating method of the above-described type from which the discussed disadvantages are eliminated and which, in particular, significantly improves the adaptation of the drawing frame for each assortment change and/or upon quality changes of the produced fiber formation.

This object and others to become apparent as the specification progresses, are accomplished by the invention, according to which, briefly stated, the regulated drawing unit for drawing fiber material includes an inlet through which the fiber material passes before being drafted; an outlet through which the fiber material passes after being drafted; a first arrangement defining a drawing field including drawing roll pairs spaced from one another in a direction of advance of fiber material; a drive system operatively connected to at least one of the drawing roll pairs for setting an extent of draft of the drawing field; a programmable control system having a memory and being connected to the drive system; a sensor for determining the mass of the fiber material running through a location and for applying signals to the memory; and a second arrangement for deriving information from data stored in the memory for adjusting the roll pair. The second arrangement includes a third arrangement for forming, from the information, a spectrogram of the fiber material and for evaluating properties of the spectrogram to use such properties in adjusting the roll pair.

The measures according to the invention make possible a significant improvement in the adaptation (setting or adjustment) of the drawing unit. From the analysis of the spectrogram, based on its shape and area, undesired type and magnitude deviations from the desired values may be recognized in a simple manner. For example, machine-specific and/or fiber technological values may be detected upon each assortment change and/or upon quality changes of the produced fiber formation. Advantageously, in the simplest case, based on an on-screen optical analysis of the spectrogram, undesired deviations during operation may be recognized and may serve for the adaptation of the drawing unit, for example, to change the distances of the nip lines and/or drafts by the operating personnel. The invention also permits a computerized evaluation of the spectrogram and a corresponding adaptation of the drawing unit, based on the results of the evaluation, either by the operating personnel or automatically by computer in connection with the regulated drawing unit proper.

The invention has the following additional advantageous features:

The spectrogram of the drawn fiber material at the output of the drawing unit is being utilized.

The spectrogram of the drawn fiber material at the input of the drawing unit is being utilized.

The shape of the spectrogram is evaluated.

The area of the spectrogram is evaluated.

The evaluation includes weighting.

The basic curve (envelope curve) of the spectrogram is evaluated.

There are determined the area under the basic curve, a rectangle whose area equals to that of the basic curve, the area of the rectangle portion projecting beyond the basic curve and the position of the point representing the center of gravity of the area of the rectangle portion.

The individual shapes projecting beyond the basic curve are evaluated.

The individual configurations projecting beyond the basic curve are evaluated.

The limit value excesses of the spectrogram are evaluated.

Envelope curves are determined for the individual configurations projecting beyond the basic curve.

For each envelope curve the distance between the upper reversal point and the basic curve, the area under each envelope curve and the position of the center of gravity of the area under each envelope curve is determined.

The magnitude of the area, the projecting basic area, the above-noted distance and/or the areas are used for adjusting the drawing unit.

An evaluation is effected in zones for shape and content.

An evaluation of partial surfaces and/or partial shapes is effected.

An evaluation of the position of the partial surfaces and shapes is effected.

An evaluation of the position of the centers of gravity of the partial surfaces and shapes is effected.

For adapting the drawing unit the distances of the nip lines of the roll pairs flanking the drawing fields are adjustable.

The drawing unit is adjustable upon conversion to a new fiber assortment.

The drawing magnitudes of the drawing fields of the drawing unit are adjustable.

The total drawing magnitude is adjustable.

The optimal nip line distances are automatically adjustable, for example, after each assortment change.

A computer, for example, a microcomputer with a microprocessor is provided which is used for the evaluation of the spectrogram and for the adjustment of the drawing unit.

The fiber mass at the measuring location is determinable on-line.

An on-line spectrogram determination is effected.

The spectrogram is di splayed on a screen or printout.

A spectral analysis is effected on-line.

The regulated drawing unit is arranged at the output of a carding machine.

The regulated drawing frame is arranged between the web trumpet of a carding machine and the rotary head of a sliver coiler.

The regulated drawing unit is arranged downstream of at least one drawing unit.

DESCRIPTION OF THE PREFERRED EMBODIMENTS

Figure 1:
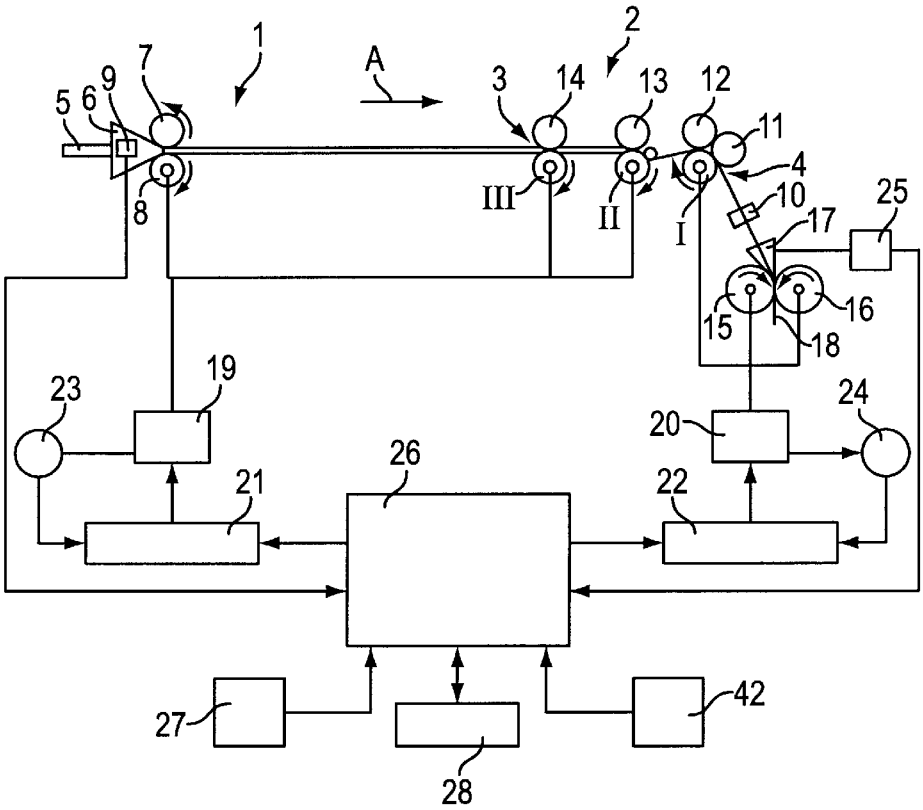
FIG. 1 is a schematic side elevational view of a regulated drawing unit, with block diagram, incorporating the invention.
Figure 2:
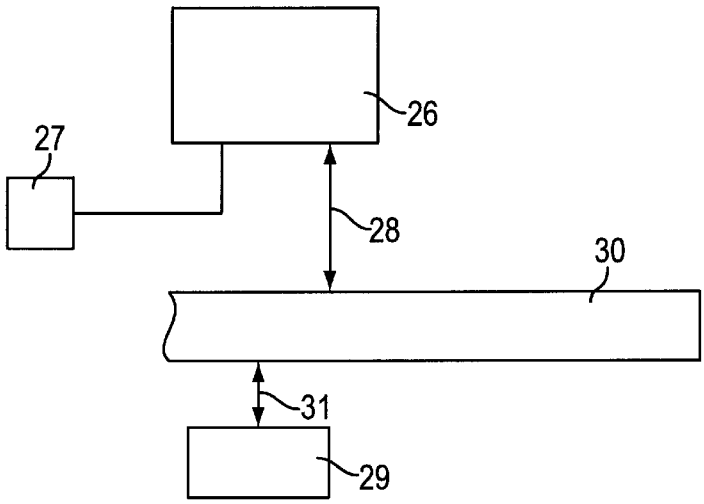
FIG. 2 is a block diagram illustrating the coupling of a computer unit with a process command computer.

FIG. 1 shows a drawing unit 2 of a drawing frame generally designated at 1 which may be an HSR model, manufactured by Trützschler GmbH & Co. KG, M önchengladbach, Germany. The drawing unit 2 has an inlet 3 and an outlet 4. A sliver bundle 5 composed of a plurality of parallel running slivers enters a sliver guide 6 after running from coiler cans designated at 48 in FIG. 5 and is pulled through a measuring member 9 by delivery rolls 7, 8 in the direction A. The drawing unit 2 is a 4-over-3 drawing unit having three lower rolls I, II and III (that is, a lower output roll I, a lower middle roll II and a lower input roll III) and four upper rolls 11, 12, 13 and 14. A drawing (drafting) of the fiber material (sliver bundle) takes place in the drawing unit 2. The drafting is composed of a preliminary drafting and a principal drafting. The roll pairs 14, III and 13, II form the preliminary drafting field whereas the roll pairs 13, II and the group of three rolls 11, 12, and I form the principal drafting field. The drawn slivers pass through a sliver guide 10 and are, by the delivery rolls 15, 16, pulled through a sliver trumpet 17 in which the individual slivers are gathered into a single sliver 18 which is subsequently deposited into coiler cans designated at 49 in FIG. 5.

The delivery rolls 7, 8, the lower input roll III and the lower middle roll II which are mechanically coupled to one another, for example, by means of a toothed belt, are driven by a regulating motor 19 with an inputted desired value. The respective upper rolls 13 and 14 are frictionally driven by the respective rolls II and III. The lower output roll I and the delivery rolls 15, 16 are driven by a main motor 20. The regulating motor 19 and the main motor 20 are each coupled to a respective regulator 21 and 22. The rpm regulation is effected in each instance by means of a closed regulating circuit in which the regulating motor 19 is associated with a tachogenerator 23 and the main motor 20 is associated with a tachogenerator 24. At the inlet 3 of the drawing unit 2 a magnitude proportional to the sliver mass, for example, the cross section of the slivers of the sliver bundle 5 is detected by a measuring organ 9 of the type disclosed, for example, in German Offenlegungsschrift (application published without examination) 44 04 326. At the outlet 4 of the drawing unit 2 the cross section of the outputted sliver 18 is measured by a measuring organ 25 associated with a sliver trumpet 17 as described, for example, in German Offenlegungsschrift 195 37 983.

A central computer unit 26 (control and regulating device), for example, a microcomputer with a microprocessor, applies, to the regulator 21, a desired magnitude for the regulating motor 19. The values measured by the two measuring members 9 and 25 are, during the drafting operation, applied to the central computer unit 26. From the measuring values delivered by the measuring organ 9 and from the desired value for the cross section of the outputted sliver 18, the desired value for the regulating motor 19 is determined in the central computer unit 26. The measuring values delivered by the measuring organ 25 serve for monitoring the outputted sliver 18 (outputted sliver monitoring). With the aid of such a regulating system, fluctuations in the cross section of the inputted slivers may be compensated for by an appropriate regulation of the drawing process, whereupon a leveling (equalization) of the output product (that is, the sliver 18) may be achieved.

With the central computer unit 26 a memory 27 is associated in which signals concerning the drawing unit control and regulating system are stored for evaluation. In case the operating speed of the microprocessor in the computer unit 26 is sufficiently high, then such a high scanning rate may be selected that a spectrogram relating to the output signal delivered by the sensor 25 and/or the input signal delivered by the sensor 9 may be obtained. The evaluation of the values contained in the memory 27 may be effected as a function of time. In a spectral analysis then the time functions are transformed into frequency functions according to the Fast-Fourier-Transform process. The time required therefor depends from the computing speed of the processor and the number of frequencies (or, as the case may be, the frequency ranges) to be examined individually. For a sufficient analysis of an inputted material preferably at least 1024 individual frequency ranges are to be examined.

Such an evaluation requires a significant processing and storing capacity of the computer proper. Such may not be always available so that the analysis has to be shifted to a process command computer 29. For this purpose, a data bus 30 may be provided and the control 20 may be provided with an interface 28 to the data bus, in which case the computer 29 too, has an interface 31 to the data bus.

Figure 3:
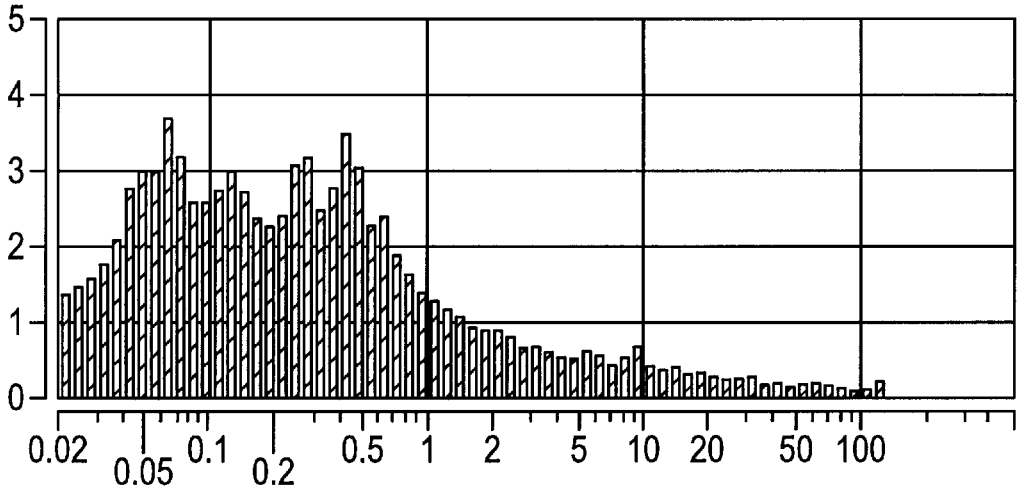
FIG. 3 is a spectrogram of a drafted fiber material (sliver bundle).

FIG. 3 illustrates a spectrogram for the outputted sliver 18. The spectrogram is obtained by a SLIVER INFORMATION SYSTEM TRÜTZSCHLER KIT model manufactured by Trützschler GmbH & Co. KG and schematically shown in FIG. 5. The horizontal axis (abscissa) of the diagram of FIG. 3 indicates the sliver length in meters and the vertical axis (ordinate) shows the periodic sliver mass irregularity (without dimension). The spectrogram shows a complex configuration from which numerical and weighted results are derived; for this purpose a spectrogram evaluation according to the invention is utilized. Preferably, the spectrograms obtained on-line by the measuring organ 25 are used for the evaluation since influences such as coiler can storage, period and conditions of storage have no effect. Expediently, the spectrograms for the evaluation are generated with absolute values from the thickness measurements.

Figure 4:
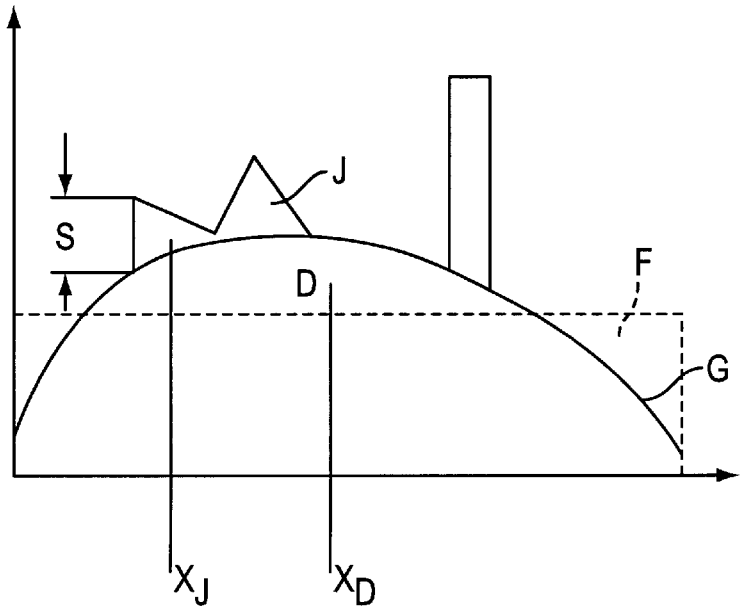
FIG. 4 is a diagram illustrating shapes and areas of a spectrogram, used for evaluation.

The spectrogram, according to FIG. 4, is examined and evaluated numerically essentially based on two criteria;

(a) the basic shape of the spectrogram and (b) the individual peaks projecting beyond the basic form.

As to (a), it is noted that the basic form is evaluated according to the first area under the basic form curve G. Thereafter, a rectangular area F is defined which has the same area as that of the basic form curve G. The size of the projecting basic form area D is determined. The position of the center of gravity of the area D on the x-axis is defined. The values for D represent the second criterion and the value $X_D$ represents the third criterion. It may be recognized already at this point that the smaller F and the smaller D the better the results.

As to (b), it is noted that the projecting peaks are enclosed in a simple envelope curve, in which case there is determined for each peak 1. its peak value S above the basic form curve;
2. its area J between the envelope curve and the basic form curve; and
3. the position of the center of gravity $X_J$ of the respective area J.

Here too, it may be recognized that the smaller the peak value S and the area J, the better the results. The two values, however, have different effects. From such evaluations magnitudes are obtained which are related to the desired yarn results or even to the results in the fabric structure. These magnitudes may be made dependent from the machine settings and also from quality values in the sliver, yarn and/or fabric structure with the purpose of determining good solution fields and determining norms. The final result, however, also depends from the properties of the material of the inputted slivers of the inputted sliver bundle 5. Different materials and different slivers at the inlet 3 of the drawing unit 2 result in different output values. Such a problem may be reduced by also measuring the slivers in the inlet trumpet 6 and generating a spectrogram from the measuring results. Such a spectrogram may be evaluated according to the above-described criteria. Thus, in this connection the initial condition of the slivers forming the sliver bundle 5 has been described and may be evaluated before the drafting operation. This permits a recognition and evaluation of the differences between the input and the output spectrograms. Such differences yield more accurate data for affecting the machine setting to the quality results in the drawing frame sliver. By virtue of the correlation between the setting parameters of the machine and the characteristics in the spectrogram norms are available and from these data and relationships setting instructions are processed for rapidly finding good results. Inasmuch as such instructions yield good results, automatic routines may also be carried out. Motor-driven setting members in the drawing unit control the settings based on instruction lists stored in the machine program. According to another embodiment, adjusting and verifying iteration may be effected automatically which makes it possible to seek and find the optimal machine settings by the machine with its own control system.

Figure 5:
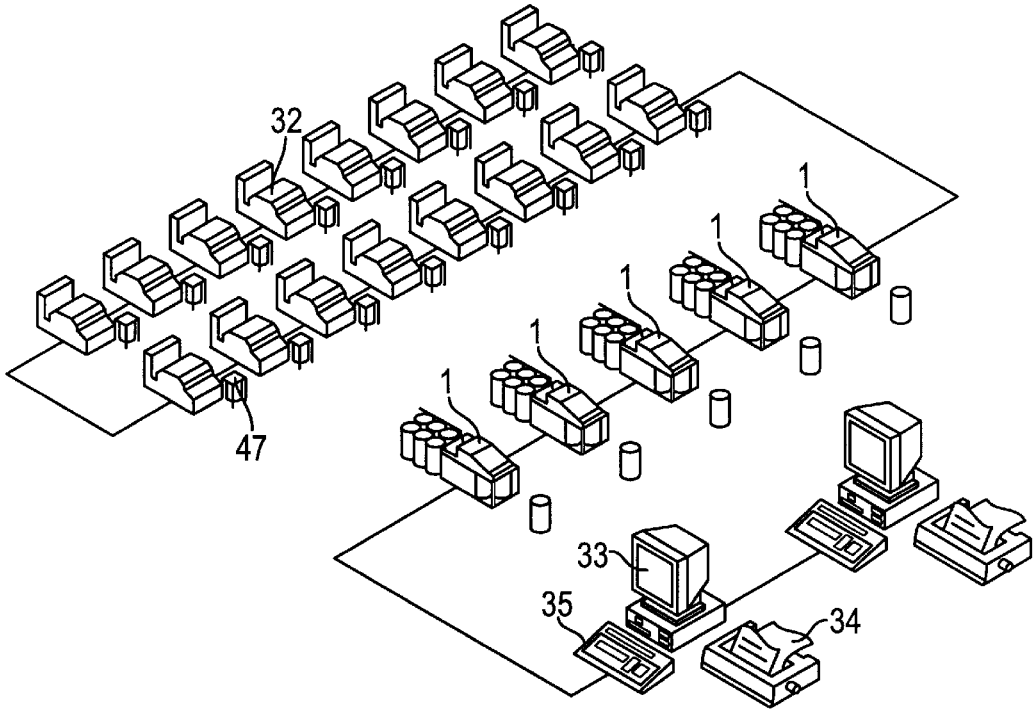
FIG. 5 is a schematic perspective view of a sliver information system incorporated in a network of carding machines and drawing frames.

FIG. 5 shows sixteen carding machines 32 (which may be DK 803 models manufactured by Trützschler GmbH & Co. KG) with which there are associated five after-connected drawing frames 1 (which may be HSR models manufactured by Trützschler GmbH & Co. KG). The machines are combined by a network in which the carding machines 32 and the drawing frames 1 are connected to a SLIVER INFORMATION SYSTEM TRÜTZSCHLER KIT, organ 25 in the sliver trumpet 17 of the drawing frames measures permanently and on-line the thickness of the sliver 18 from which, by means of the KIT system, the spectrograms and the spectrogram analyses are obtained and represented as graphs or tables and displayed on a screen 33 or a printer 34. The reference numeral 35 designates a keyboard, while 47 denotes a coiler for the carded sliver.

Figure 6:
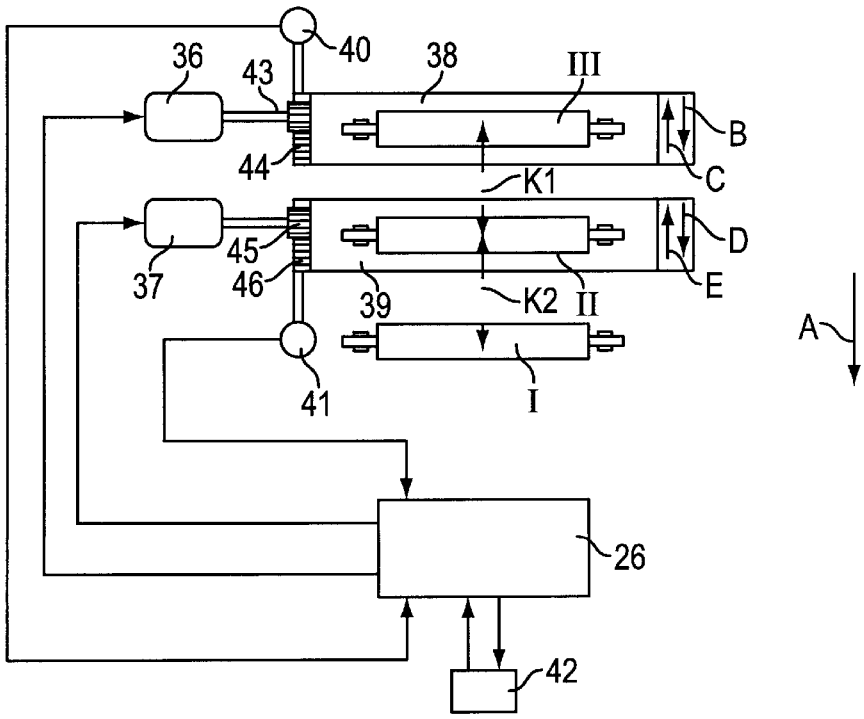
FIG. 6 is a block diagram illustrating a computer-controlled, motor-driven adjustment of the nip line distances of drafting rolls in a regulated drawing unit.

Also referring to FIG. 6, the operator may manually input the nip line distances $K_1$ and $K_2$ of the drawing roll pairs by means of a keyboard 42 into the computer 26 which stores the data and based thereon, controls the motors 36 and 37—which may be stepping motors—for setting the nip line distances. The motor 36 drives a pinion 43 meshing with a rack 44 attached to a carriage 38 on which the roll III is mounted, while the motor 37 drives a pinion 45 meshing with a rack 46 attached to a carriage 39 on which the roll II is mounted. In this manner the carriages 38 and 39 may be displaced in the directions B, C and D, E, respectively. The position of carriages 38, 39 may be measured by means of analog or digital measuring members 40, 41 and inputted into a read/write memory of the computer 26. The latter, in turn, compares these actual values with the inputted desired values for the carriage positions and thereafter the motors 36, 37 are operated by the computer 26 until the desired values correspond to the actual values. The optimal nip line distances $K_1$ and $K_2$ are set principally based on the staple length of the processed fibers and may thus be preset. In addition, however, properties such as fiber bulkiness, sliver unity, etc., have an effect on the optimal nip line distances which may be optimized empirically. Such an optimization may then be transferred to the computer 26 which, based on an inputted or on a continuously available program, varies repeatedly the nip line distances $K_1$ and $K_2$ and after each new setting the irregularity of the drafted and doubled sliver 18 is measured by the measuring trumpet 17, and the signal generated by the measuring funnel 17 and converted by the transducer 28 is stored over a predetermined period and evaluated. After performing such measurements and evaluation and storing the obtained data, the computer 26 computes from these data the optimal nip line distances $K_1$ and $K_2$ and provides for an automatic adjustment. The nip line distances $K_1$ and $K_2$ may also be continuously shown on display fields.

Figure 7:
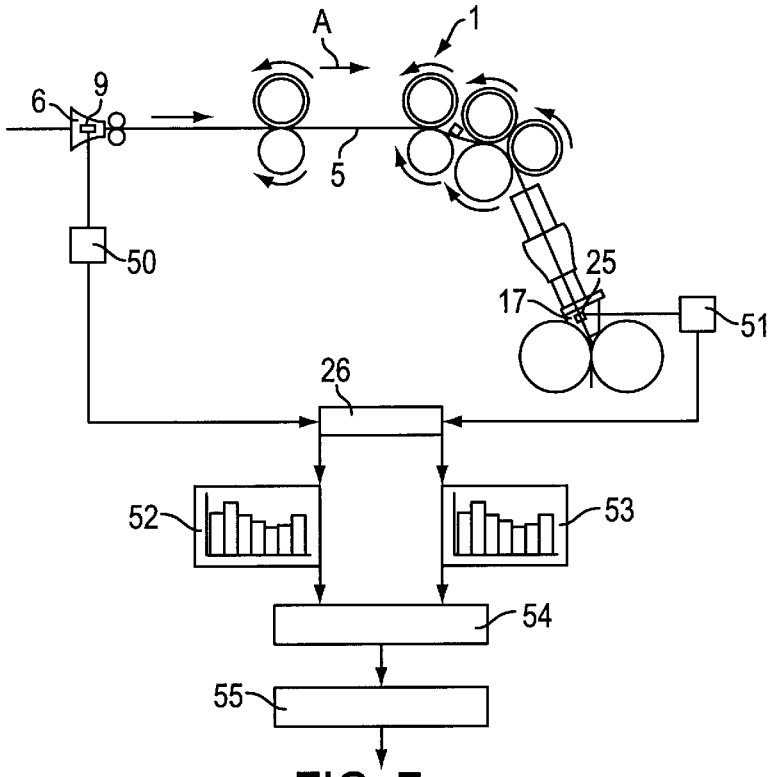
FIG. 7 is a schematic side elevational view of a regulated drawing frame with block diagram for forming and evaluating spectrograms of a sliver bundle upstream of the inlet and downstream of the outlet of the drawing unit for the manual adjustment thereof.

Turning to FIG. 7, the intake measuring organ 9 is connected by a transducer 50 and the outlet measuring organ 25 is connected by means of a transducer 51 with the computer 26 which, in turn, applies signals to two devices 52, 53 for forming a respective spectrogram for the inputted sliver bundle 5 and for the discharged sliver bundle 18, respectively. The devices 52, 53 are connected to an evaluating device 54 in which the spectrograms generated in the two devices 52 and 53 are evaluated as to form and area. The data on the results of the evaluation are inputted in a computer 55 in which data on known relationships (for example, shape of the spectrograms related to the machine specific and/or fiber technological parameters) are stored. The computer 55 outputs recommendations for the machine parameters and operating parameters, for example, on a display, screen or printer. Based on the recommendations, a manual setting of the machine may be effected as explained as a mode of operation in conjunction with FIG. 6.

Figure 8:
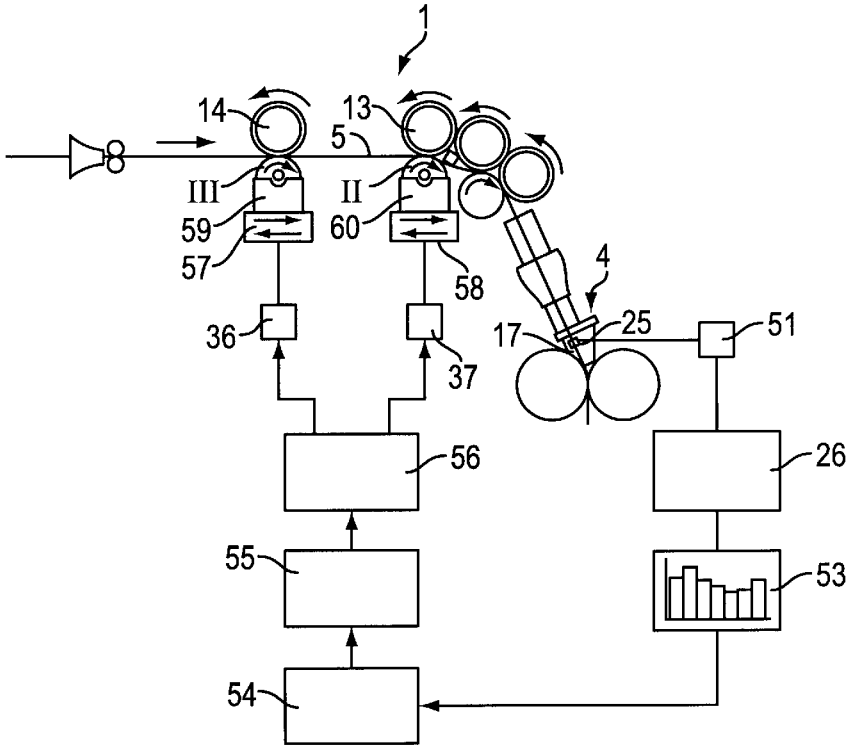
FIG. 8 is a schematic side elevational view of a regulated drawing frame with block diagram for forming and evaluating a spectrogram of a sliver bundle downstream of the outlet of the drawing unit for the automatic adjustment thereof.

Turning to FIG. 8, the measuring organ 25 at the outlet 4 is connected by means of the transducer 51 with the computer unit 26 which, in turn, applies signals for a device for forming a spectrogram for the outputted sliver bundle 18. The device 53 is coupled to the evaluating unit 54 in which the spectrogram generated in the device 53 is evaluated based on its configuration. The results of evaluation are inputted in the device 55 which, in turn, outputs recommendations for the machine parameters and operating parameters to the machine control and regulating device 56 for adjusting the drawing unit 2. The machine control and regulating unit 56 is connected with setting members of the regulated drawing frame 1; a setting motor 36 drives a shifting device 57 for the horizontal displacement of the roll pair 14, III, and the setting motor 37 operates a displacing device 58 for the horizontal shifting of the roll pair 13, II in directions as shown in FIG. 6. The rolls II and III are supported in respective holders 60 and 59. In this manner an automatic setting of the drawing unit 2 is effected based on the evaluation results of the spectrogram.

Figure 9:
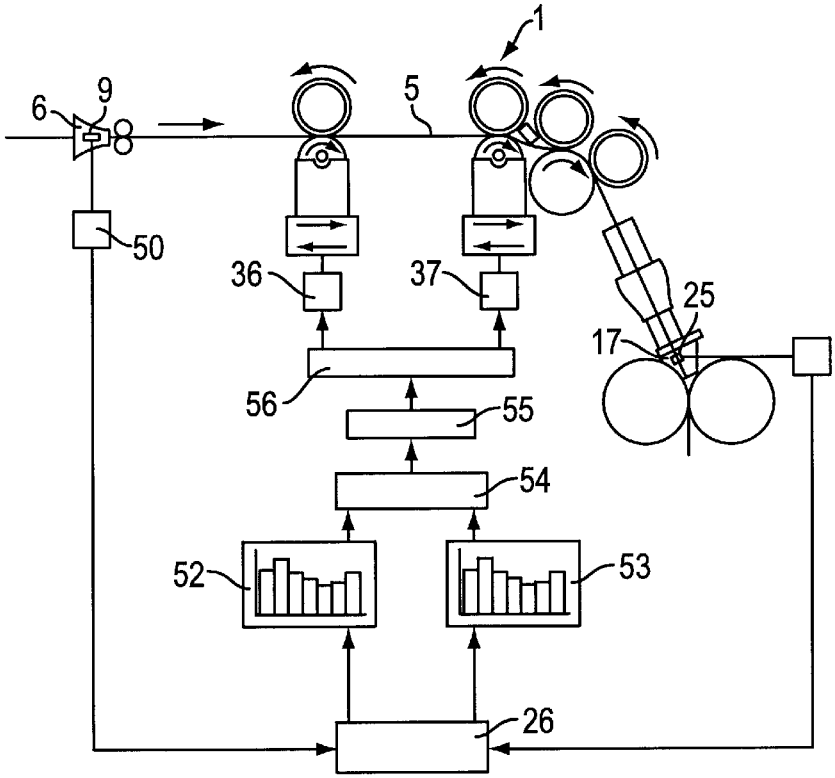
FIG. 9 is a regulated drawing frame with block diagram similar to FIG. 7 for an automatic adjustment of the drawing unit according to a variant.

The embodiment illustrated in FIG. 9 essentially corresponds to that shown in FIG. 7; the computer 55, corresponding to the illustration in FIG. 8, receives signals from the machine control and regulating device 56 and is connected to the shifting elements 36, 57 and the shifting elements 37, 58 for the automatic setting of the roll pairs 14, III and 13, II, respectively. Further, the arrangement of FIG. 9 permits a comparison between the spectrograms generated in the devices 52 and 53.

Figure 10:
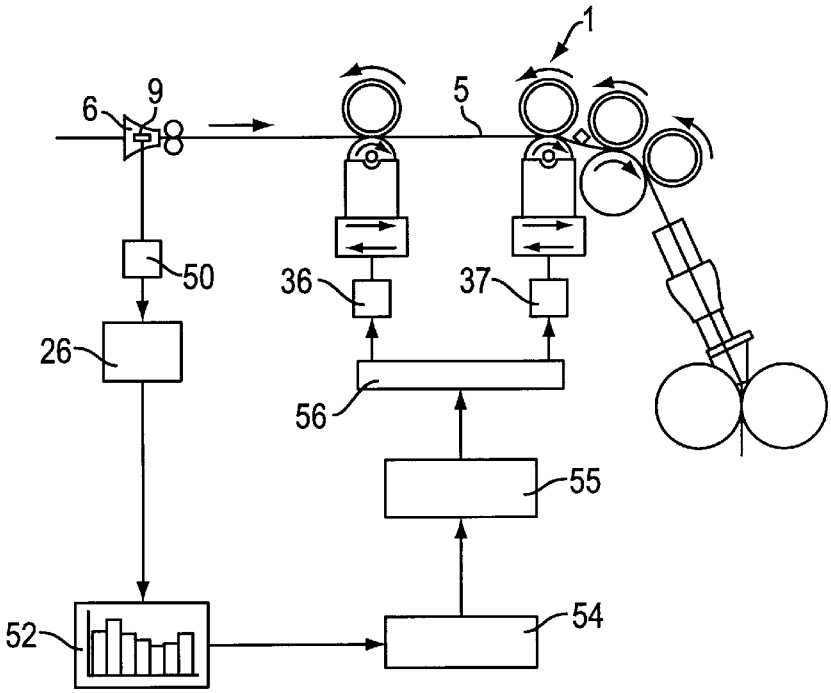
FIG. 10 is a schematic side elevational view of a regulated drawing frame with block diagram for forming and evaluating a spectrogram of a sliver bundle upstream of the inlet of the drawing unit for the automatic adjustment thereof.

The embodiment according to FIG. 10 corresponds to that of FIG. 9, except that according to FIG. 10 only signals from the intake measuring organ 9 are use d for evaluating a spectrogram corresponding to the inputted sliver bundle 5 and for the automatic setting of the drawing unit 2.

In the embodiments shown in FIGS. 8, 9 and 10, as setting members shifting elements 36, 57 and 37, 58 are used for setting the clamping line distances of the roll pairs. The evaluating results may be utilized by the machine control and regulating device 56 also for setting the regulating motor 19 and/or the main motor 20 (FIG. 1) and thus for changing the extent of draft. The evaluation s may be utilized by the machine control and regulating device 56 also for two processes, that is, for the changing the nip line distances of the drawing unit 2 and for altering the extent of draft.

A plurality of regulated drawing frames 1 may be connected to the computer 26 as illustrated in FIG. 5. According to FIG. 1, a central computer unit 26 may be provided which forms and evaluates the spectrograms and also performs the control and regulating tasks for the regulated drawing frames 1. The forming and evaluation of the spectrograms may also be performed in the computer 26 and the regulated drawing frames 1 may each have its own control and regulating device 56 as shown in FIGS. 8, 9 and 10.

The invention was described in an exemplary manner in connection with a regulated drawing frame 1. It is to be understood that the invention can find application in other machines which have a regulatable drawing unit 2, for example, a carding machine 32, combing machines and the like. The invention may also find application in a carding machine in which the fiber material is drawn on the clothed rolls in the working direction.

It will be understood that the above description of the present invention is susceptible to various modifications, changes and adaptations, and the same are intended to be comprehended within the meaning and range of equivalents of the appended claims.

What is claimed is:

1. In a regulated drawing unit for drawing fiber material, including an inlet through which the fiber material passes before being drafted;

an outlet through which the fiber material passes after being drafted;

first means for defining a drawing field including drawing roll pairs spaced from one another in a direction of advance of fiber material;

a drive system operatively connected to at least one of said drawing roll pairs for setting an extent of draft of said drawing field;

a programmable control system connected to said drive system; said programmable control system having a memory;

a sensor for determining at a location the mass of the fiber material running through said location and for applying signals to said memory; and second means for deriving information from data stored in said memory for adjusting said at least one roll pair;

the improvement wherein said second means comprises third means for forming from said information a spectrogram of said fiber material and for evaluating properties of said spectrogram to use said properties in adjusting said at least one roll pair.

2. The regulated drawing unit as defined in claim 1, wherein said location is situated at said outlet.

3. The regulated drawing unit as defined in claim 1, wherein said location is situated at said inlet.

4. The regulated drawing unit as defined in claim 1, further wherein said roller pairs include a first and a second roller pair being spaced from one another and defining a drawing field therebetween; further wherein said first and second roller pairs have a nip line defined by the rollers of the respective first and second roller pairs; further comprising adjusting means connected to at least one of said first and second roller pairs and to said second means for adjusting a distance between the nip lines of said first and second roller pairs as a function of data derived from said spectrogram.

5. The regulated drawing unit as defined in claim 1, wherein said third means comprises a computer.

6. The regulated drawing unit as defined in claim 1, in combination with a carding machine having an outlet; said drawing unit is coupled to said outlet of said carding machine.

7. The combination as defined in claim 6, further comprising a sliver coiler coupled operatively downstream of said outlet of said carding machines viewed in said direction of advance of the fiber material; said sliver coiler including a coiler head and said carding machine including a sliver trumpet situated upstream of said outlet of said carding machine; said regulated drawing unit being disposed between said sliver trumpet and said coiler head.

8. In a regulated drawing unit for drawing fiber material, including an inlet through which the fiber material passes before being drafted;

an outlet through which the fiber material passes after being drafted;

first means for defining a drawing field including drawing roll pairs spaced from one another in a direction of advance of fiber material;

a drive system operatively connected to at least one of said drawing roll pairs for setting an extent of draft of said drawing field;

a programmable control system connected to said drive system; said programmable control system having a memory;

a sensor for determining at a location the mass of the fiber material running through said location and for applying signals to said memory; and second means for deriving information from data stored in said memory for adjusting said at least one roll pair;

the improvement wherein said second means comprises third means for forming from said information a spectrogram of said fiber material, for evaluating properties of said spectrogram and for adjusting the regulated drawing unit based on the evaluated properties of said spectrogram.

9. A method of controlling a regulated drawing unit for drawing running fiber material; said regulated drawing unit including an inlet through which the fiber material passes before being drafted and an outlet through which the fiber material passes after being drafted; the method comprising the following steps:

(a) sensing properties of the fiber material at a location of the regulated drawing unit for determining density of the fiber material running through said location;

(b) generating signals representing said properties;

(c) generating a spectrogram from information derived from said signals; said spectrogram having a basic shape curve;

(d) evaluating properties of said spectrogram including the steps of (1) superposing a rectangle on the basic shape curve, whereby one portion of said rectangle projects beyond said basic shape curve; said rectangle having an area identical to that of the basic shape curve; and (2) determining the area of said portion of said rectangle and the position of a point representing the center of gravity of the area of said portion of said rectangle; and (e) adjusting the regulated drawing unit based on the evaluated properties of said spectrogram.

10. The method as defined in claim 9, wherein step (d) includes the step of evaluating individual shapes projecting beyond said basic shape curve.

11. The method as defined in claim 10, further comprising the step of determining envelope curves for said individual shapes.

12. The method as defined in claim 11, further comprising the step of determining, for each said envelope curve, the distance between the upper reversal point of the envelope curve and the basic shape curve, the area under each said envelope curve and the position of the point representing the center of gravity of the area under each said envelope curve.

13. The method as defined in claim 12, wherein step (e) comprises the step of adjusting the regulated drawing unit as a function of one of the area of the rectangle, the area of said portion of said rectangle, said distance, at least one of said portion of said rectangle, the area under said envelope curves, and a combination thereof.

14. A method of controlling a regulated drawing unit for drawing running fiber material; said regulated drawing unit including an inlet through which the fiber material passes before being drafted and an outlet through which the fiber material passes after being drafted; the method comprising the following steps:

(a) sensing properties of the fiber material at a location of the regulated drawing unit for determining density of the fiber material running through said location;

(b) generating signals representing said properties;

(c) generating a spectrogram from information derived from said signals;

(d) evaluating properties of said spectrogram comprising evaluating said spectrogram in zones as to shape and area; and (e) adjusting the regulated drawing unit based on the evaluated properties of said spectrogram.

15. The method as defined in claim 14, wherein step (a) comprises the step of sensing at said outlet.

16. The method as defined in claim 14, wherein step (a) comprises the step of sensing at said inlet.

17. The method as defined in claim 14, wherein step (e) comprises the step of adjusting the extent of draft on at least one drawing field of the regulated drawing unit.

18. The method as defined in claim 14, wherein said regulated drawing unit includes drawing roll pairs spaced from one another in a direction of advance of fiber material; each drawing roll pair defining a nip line; further wherein step (e) comprises the step of automatically adjusting a distance between nip lines.

19. A method of controlling a regulated drawing unit for drawing running fiber material; said regulated drawing unit including an inlet through which the fiber material passes before being drafted and an outlet through which the fiber material passes after being drafted; the method comprising the following steps:

(a) sensing properties of the fiber material at a location of the regulated drawing unit for determining density of the fiber material running through said location;

(b) generating signals representing said properties;

(c) generating a spectrogram from information derived from said signals;

(d) evaluating properties of said spectrogram comprising evaluating one of partial shapes and partial areas of said spectrogram; and (e) adjusting the regulated drawing unit based on the evaluated properties of said spectrogram.

* * * * *